US006439803B1

(12) United States Patent
Lowe

(10) Patent No.: US 6,439,803 B1
(45) Date of Patent: Aug. 27, 2002

(54) SNOWPLOWABLE PAVEMENT MARKER

(76) Inventor: Harry E. Lowe, 1030 Seaview Ct., Schaumburg, IL (US) 60193

( * ) Notice: Subject to any disclaimer, the term of this patent is extended or adjusted under 35 U.S.C. 154(b) by 0 days.

(21) Appl. No.: 09/420,036

(22) Filed: Oct. 18, 1999

(51) Int. Cl.[7] ..... E01F 9/04
(52) U.S. Cl. ..... 404/14; 404/12; 404/13
(58) Field of Search ..... 404/12, 13, 14, 404/15, 16

(56) References Cited

U.S. PATENT DOCUMENTS

| | | | | | |
|---|---|---|---|---|---|
| 4,147,447 | A | | 4/1979 | Heenan et al. | |
| 4,155,666 | A | | 5/1979 | Flanagan | |
| 4,174,184 | A | | 11/1979 | Heenan | |
| 4,195,945 | A | | 4/1980 | Heenan | |
| 4,362,425 | A | * | 12/1982 | Dixon | 404/16 |
| 4,395,155 | A | | 7/1983 | Bartolotti | |
| 4,498,733 | A | * | 2/1985 | Flanagan | 404/14 |
| 4,634,310 | A | * | 1/1987 | Clarke | 404/15 |
| 5,257,875 | A | | 11/1993 | Flanagan | |
| 5,277,513 | A | | 1/1994 | Flanagan et al. | |
| 5,454,664 | A | | 10/1995 | Siblik | |
| 5,667,335 | A | * | 9/1997 | Khieu et al. | 404/14 |
| 5,816,737 | A | * | 10/1998 | Siblik | 404/13 |
| 5,975,794 | A | * | 11/1999 | Hedgewick | 404/14 |
| 6,102,612 | A | * | 8/2000 | Pricone et al. | 404/13 |
| 6,116,812 | A | * | 9/2000 | Hedgewick | 404/14 |

* cited by examiner

*Primary Examiner*—Thomas B. Will
*Assistant Examiner*—Alexandra K. Pechhold
(74) *Attorney, Agent, or Firm*—Harness, Dickey & Pierce, P.L.C.

(57) ABSTRACT

A very low-profile snowplowable pavement marker mounted in an elongated groove formed in a highway pavement, the groove extending longitudinally of the highway and exposing the reflective highway marker to the headlights of oncoming motor vehicles when their approach distance from the reflective highway marker is adequate for highway guidance purposes. The reflective highway marker is a metal casting with a reflector mounted in a pocket formed in the casting. The casting is adhesively installed in a deepened section of the groove. The protective rails of the casting are situated slightly above the pavement surface, but are significantly lower than rails of prior art snowplowable castings. The leading edge of the reflector support is below pavement level and allows light from oncoming headlights to enter the reflector without the shadowing effect prevalent in conventional low-profile marker castings. The elongated groove is much shallower and longer than grooves of prior art, and allows for car tires to enter and clean the reflector in the casting.

8 Claims, 3 Drawing Sheets

SNOWPLOWABLE PAVEMENT MARKER

BACKGROUND OF THE INVENTION

The present invention relates to pavement markers which are recessed into the pavement surface. The pavement marker is designed for use in areas that receive snowfall and hence, is designed to be snowplowable while resistant to damage from the action of the snowplow.

SUMMARY OF THE PRIOR ART

Pavement markers, as used herein, are mechanisms for setting a reflective element in or on the roadbed so that the light of the vehicle headlamps can be reflected back to the driver. The source of the reflection delineates edges of lanes, on/off ramps, and other features of the roadbed. These pavement markers are used in addition to, or instead of, standard paint, epoxy, or thermoplastic striping.

Pavement markers are generally broken down into two types—sun country or snowplowable. Sun country markers are used where snow is either not present or an infrequent event, and thus their design does not have to take into account the operation of a snowplow to clear the traffic lanes. Snowplowable markers, as the name implies, are designed to be placed on roadbeds where snowplows operate. The markers are designed to accommodate the action of snowplow blades which can be a major source of damage to the pavement marker and its reflective element. Damage occurs because the snowplow blade is traveling at approximately traffic speeds and contacts the portion of the pavement marker above the pavement level. Because of the considerable mass of the snowplow blade, its momentum causes a jolt that is felt by the driver as the blade is guided up and over the marker so that it avoids impacting the reflective element. The jolt results from the resistance of the pavement marker and the pavement to the impact of the snowplow blade. In addition to transferring energy back to the snowplow truck and driver, the jolt also transfers energy to the pavement marker. If sufficient energy is transferred to the pavement marker, the pavement marker can be literally ripped out of the pavement. Snowplows may also damage the pavement markers by having the leading tip of the blade enter the marker at such a point that the blade is not guided over the marker, but rather impacts the reflector directly. At highway plowing speed the snowplow blade does not immediately return to pavement level. Rather, the blade travels vertically before dropping to pavement level, thus leaving transverse strips or patches of unplowed snow.

An example of a prior art snowplowable pavement marker is shown in U.S. Pat. No. 4,195,945. These type of markers generally have an H pattern when viewed in a plan view. The legs of the H are made up of ramps which are designed to guide the snowplow blade up and over the centrally mounted reflector element. These prior art pavement marker bases are designed to be placed into a groove in the pavement which is cut usually by means of a circular saw. The groove is approximately the length of the pavement marker. The groove is arcuate from the action of the rotating sawblades. The pavement marker is then placed within the groove and adhered to the pavement through the use of epoxy. A variation of that same type of marker is seen in U.S. Pat. No. 5,277,513 which calls for the same basic design with only minor dimensional changes. In cases of the prior art pavement markers such as referenced immediately above, the reflector is carried at or above the pavement level as determined by the web which interconnects the ramps on either side of the marker. The leading edge of the web is dimensioned to be at or above the surrounding pavement level. In these prior art designs it is recognized that there was a continuing problem to reduce the overall height of the reflector of the pavement marker to a minimum level above the roadway while still maintaining the reflector above the roadway surface. See, for example, the '513 patent at Col. 2. The impetus to maintain the reflector above the roadway surface came from the recognition that the reflector needed to be exposed to the light from the oncoming headlights in order to have some light to reflect back. Greater height above the roadway provided this. Working against this goal, however, was the recognition that the higher the pavement marker was above the roadway, the more of an obstacle it presented to an oncoming snowplow, and the greater damage it would receive from impact with the snowplow. See, ibid. Therefore, the prior art as represented by the above references sought to change the various dimensions such as ramp angles, widths, heights, etc. to force the snowplow blade over the reflector while still keeping the leading edge of the web which carried the reflector at or above the level of the surrounding pavement.

Another type of prior art consisted of grooves cut in the pavement where the depths of the grooves increased in the direction of vehicle travel. At the bottom of the groove, a retroreflector was mounted below grade level. An example showing a two way snowplowable marker is shown in U.S. Pat. No. 4,395,155 to Bartolotti. This reflector could also be mounted at one end of the groove for a one-way plowable marker. While providing snowplow protection, this installation has had limited use for a variety of reasons, including the filling of the groove with road debris such as dirt, sand, eroded pavement, and the fact that the reflector was below pavement level served to limit the reflective light to the motorist. As stated in the patent, the groove cut in the pavement was narrower than the width of vehicle tires to prevent destructive contact between the vehicle tires and the reflector.

OBJECTIVES OF THE INVENTION

The objectives of the invention are:

- to provide a pavement marker that is resistant to damage from snowplow blades and protects the retroreflector;
- to provide a pavement marker which is self-cleaning to resist blocking of the retroreflector from oncoming light due to road debris collecting in front of or on the reflector;
- to provide a pavement marker that is of very low profile having a minimum amount of the marker protruding above the surface of the pavement;
- to provide a pavement marker that is easily installed, using conventional equipment and techniques;
- to provide a pavement marker that can utilize standard or existing retroreflector elements;
- to provide a pavement marker that has the reflector carrying web between the ramps initially below the pavement surface so as to reduce snowplow blade impact while allowing openess to oncoming light;
- to provide a pavement marker with the web element or the portion between the ramps entirely below the pavement surface;
- to provide a pavement marker for installation at the end of long approach grooves cut in the pavement such as found in several northeastern states;
- to provide a pavement marker that minimizes use of installation adhesive, as well as minimizing unsightly overflow of adhesive; and to provide a pavement marker whereby rail height is reduced by allocating structural integrity responsibility to nearby structures.

SUMMARY OF THE INVENTION

The above advantages are obtained and several others will become apparent from the description of the present invention. The present invention includes a low profile pavement marker base member for use in snow areas on which a retroreflector is mounted to provide reflected light back to an oncoming vehicle. The pavement marker base is designed to be mounted within a deepened section of a groove in the pavement located just before the front edge of the pavement marker base. The front edge of the pavement marker, and especially its reflector carrying web, is designed to be mounted below the pavement level so that oncoming light traveling down the groove continues into the pavement marker base between the ramps and impinges upon the retroreflector. In one preferred embodiment the pavement marker is a one way marker, i.e. it is designed to receive the snowplow blade from one direction only. In an alternate embodiment, the marker can be two-way by replicating the ramps and reflective element as shown in FIG. 5, although the overall length will be less than twice the length of a one way reflector and other dimensions will have to be adjusted accordingly. For example, the ramp angle will have to be steeper to bring the plow blade over the reflector in a shorter distance, but the beginning of the web will still be below pavement level.

The pavement marker includes a base member with two longitudinally extending and laterally spaced apart ramps. The ramps are designed to start at a level below pavement and extend above the pavement level to help guide the snowplow blade up and over the retroreflector. The bottom side of the reflector base has a series of cleats or treads on either side to help anchor the base into a prepared roadway through the use of epoxy. The cleats help prevent dislocation of the pavement marker base relative to the roadway. Positioning tabs can be included on either side of the pavement marker base to align the marker relative to the surrounding pavement. The retroflector is carried in a pocket on the web which preferably spans the ramps along their entire length. The proper placement of the marker will put the retroreflector starting at a level below the pavement extending to a level above the surrounding pavement, but still protected by the ramps of the pavement marker base from the snowplow blade. The reflector will be exposed to light from both above pavement level and light traveling down the cut groove.

The combined pavement marker base and retroreflector is designed to be placed in a groove cut in the pavement. The pavement marker is designed for a groove that is cut with a long approach, i.e. started several marker lengths before the position where the casting will actually be placed. The length of the groove is designed in part to allow more light to impinge upon the retroreflector as explained in more detail below. The retroreflector is adhered to the base by use of an adhesive and the marker is adhered to the pavement with adhesive such as epoxy.

DETAILED DESCRIPTION OF THE INVENTION AND PREFERRED EMBODIMENTS

The present invention has a reflector 10 mounted in a base 12 to reflect light from the headlamps of a vehicle back to the driver of the vehicle. Reflector or retroreflector as used herein can be a plastic, glass or composite material designed to reflect the light from oncoming headlamps back to the driver. Prior art metallized lens can also be used. For examples of reflectors, see Balint, U.S. Pat. No. 3,409,344 which discloses acrylic lens elements in an ABS housing. Another example of a retroreflector element is shown in Flanagan, U.S. Pat. No. 4,498,733. Various models of reflectors known to those in the art can be used such as Stimsonite Model 944 retroreflector, available in the trade or 3M model #194 of retroreflector.

Figure 2:
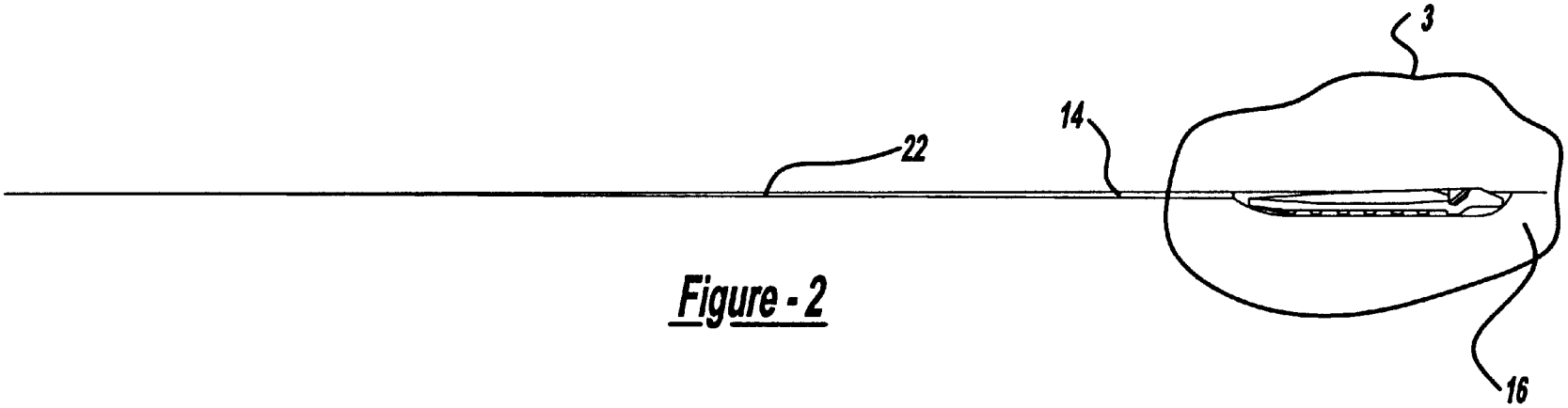
FIG. 2 is a cross sectional diagram of a preferred installation.

As shown in FIG. 2, the present marker is designed to be placed in a groove 14 cut in the pavement 16. The groove is several times the length of the marker. The length of the groove is determined in part by the need for light to travel in the groove to impinge on the reflector. Since the vehicle light is emanating from a point some distance above the pavement surface (the height of the headlamps above the pavement) and a portion of that light is angled downward towards the pavement, the retroreflector does not have to be above the pavement to be seen. The more light that impinges on the retroreflector, however, will increase the distance at which the retroreflector can be seen and hence, provide greater time to the vehicle driver to adjust to the marker's delineation. State and Federal regulation use a 0.2° observation angle. That angle is determined by the angle between the light from the headlamps and the reflected light to the driver's eyes. The distance at which this reflected light is seen by the driver is preferable at least 600 feet from the reflector.

Figure 1:
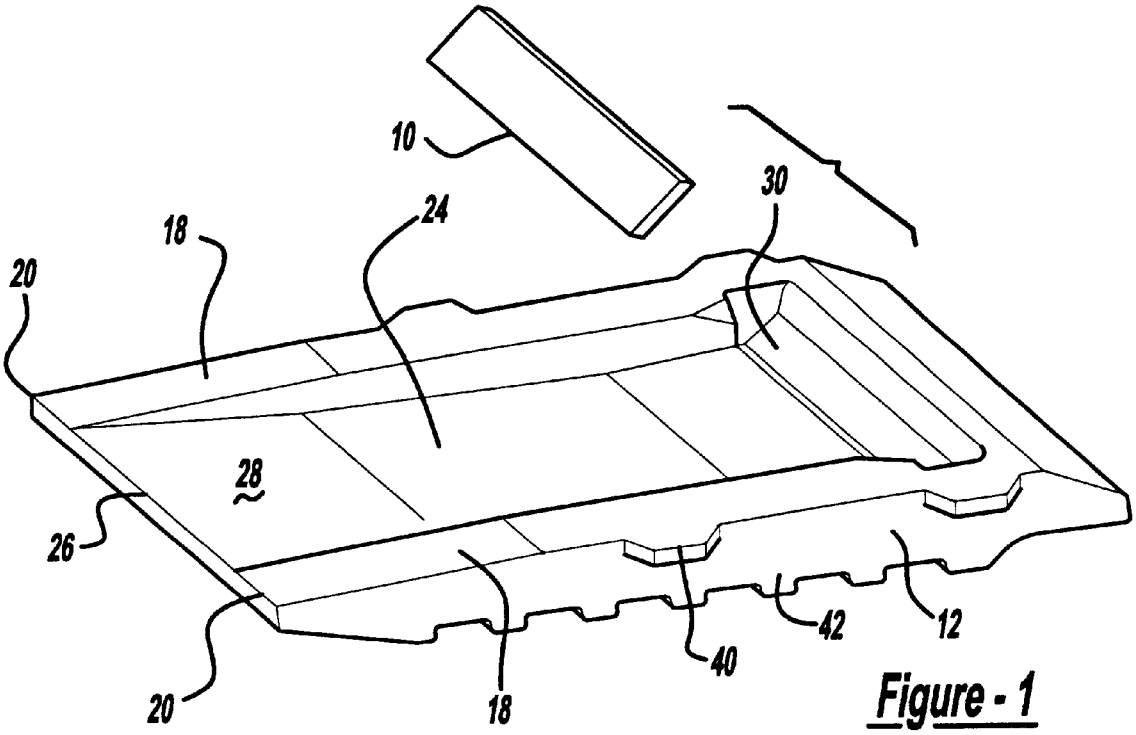
FIG. 1 is a perspective view of an embodiment of the marker base with a separated reflector.
Figure 3:
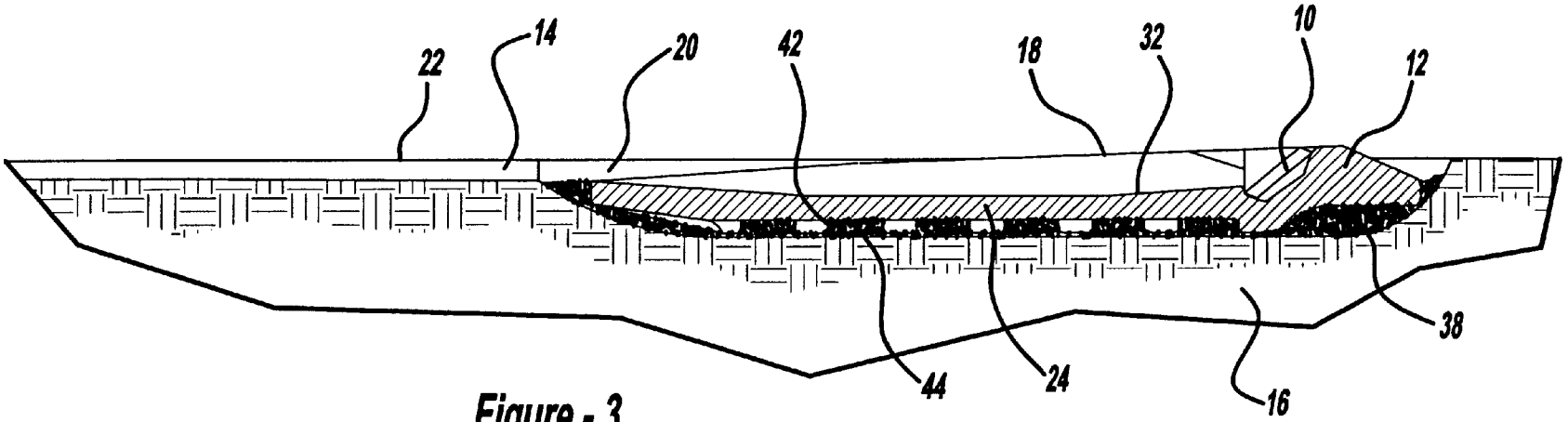
FIG. 3 is an enlarged view of the circled portion of FIG. 2.

As shown in FIGS. 1 and 3, the preferred embodiment generally includes a cast iron base 12. The case iron base is made of pearlitic ducile iron such as ASTM 536. The marker base is preferably cast in one piece and then subject to a heat treatment of heating, quenching, and tempering to a Rockwell C hardness of approximately 52–54.

The marker base has two longitudinally extending and laterally spaced apart ramps 18. The ramps are designed so that their leading ends 20 are intended to be placed below the uncut pavement level 22. The ramps extend so that their ends near the reflector are designed to be at a level above the uncut pavement level 22. The ramps are sloped to raise an oncoming plowblade up and over the casting.

The ramp angles are designed to quickly, yet gently, lift the snowplow blade up for eventual clearance over the reflector. The initial angle may be four degrees and the subsequent angle one degree. These angles are notably smaller than many prior art ramp angles because less of the marker is above the highway, and thus exposed to the snowplow blade. Likewise, less of the reflector is above the highway surface and thus is better protected from the snowplow blade. This lower profile also has the benefit of less jolt to the operator to the snowplow with correspondingly less energy being transferred to the marker itself and therefore less chance of the marker being knocked loose from the pavement. The snowplow blade will also quickly return to the pavement level after clearing the reflector with less unplowed snow being left behind due to plowblade "hop".

Figure 5:
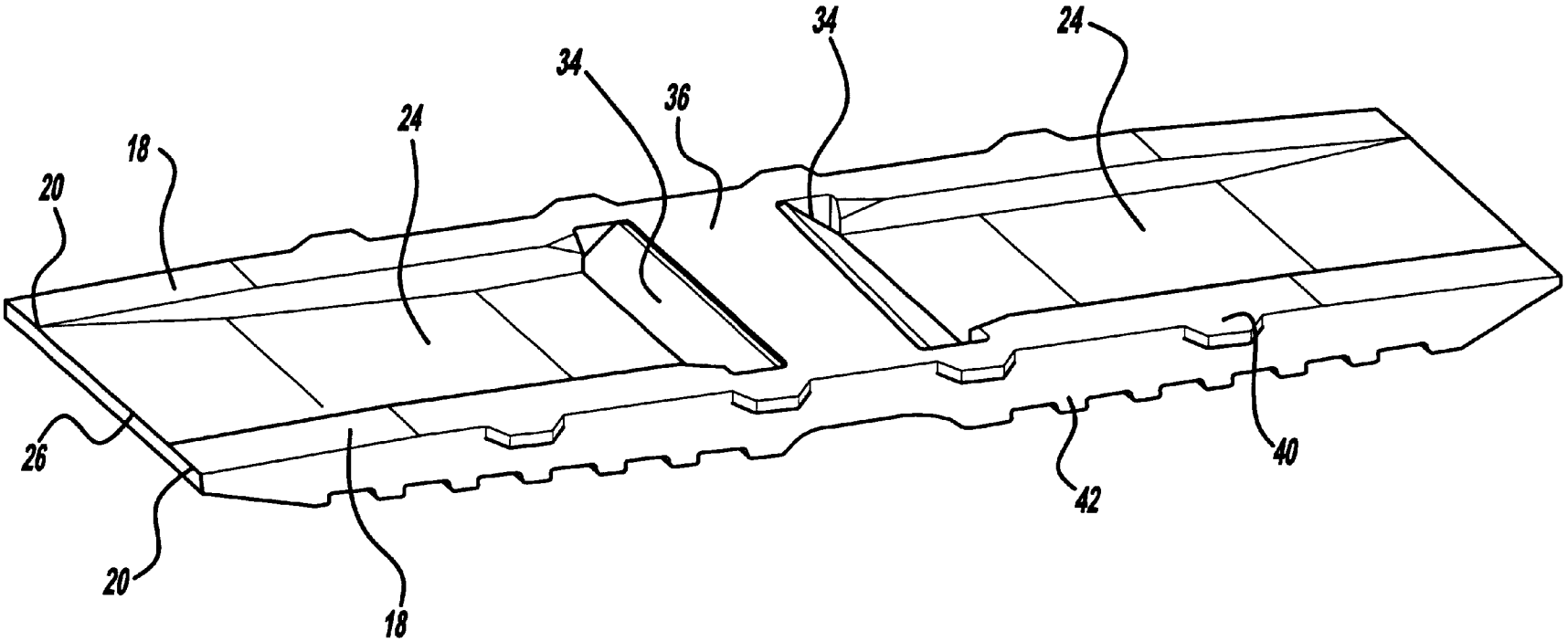
FIG. 5 is an alternate embodiment showing a two-way marker.

The ramps are connected by a web 24. In the preferred embodiment, the web runs the entire length of the ramps, or substantially so. The web and its length allow the ramps themselves to be made less substantial, i.e. the ramps can be less massive and still resist breakage from impact due to some of the load being transferred to and through the web. This further aids in achieving a low profile for the ramps. In the preferred embodiment, the leading edge of the upper ramp surfaces and the web are co-linear 26. Alternatively, the leading edge of the web could start at a level below the leading upper edge of the ramps. The web gradually slopes downward along the longitudinal axis 28 and terminates in a reflector pocket 30. The web slopes down further away from the datum plane as it approaches the reflector pocket 30, then tapers off and becomes roughly parallel to the road surface in the area 32 immediately preceding the reflector pocket. The initial sloping allows for light rays which will travel down the groove cut in the pavement to continue at an angle relative to the datum plane for impingement upon the reflector. At no point should the web be at or above the road surface 22 as this would block light traveling down the cut in the pavement from impinging upon the reflector surface. Thus, light from oncoming vehicles, traveling down the cut in the pavement, as well as that traveling at or above the datum level, can penetrate into the area between the ramps for impingement upon the reflector surface and reflectance back to the vehicle operator. Depending upon the intended use of the marker, the reflector pocket can be spaced to accommodate a one-way reflector such as shown in FIG. 1, or a two-way reflector such as shown in FIG. 5. In a two-way reflector such as shown in FIG. 5, the reflective element can consist of two separate reflectors back to back 34, separated by a vertical wall of metal 36 between them, and/or having a metal strap over the top for protection.

The reflector pocket 30 is sized to accommodate a standard size reflector element 10. In the preferred one-way embodiment, the 3M 194 reflector element is used. The reflector element is adhered to the pocket through use of adhesives 38 such as polyurethane. An example is Accuflex marketed by the Accuseal Company.

Tabs 40 may protrude from the outer sides of the rails. The tabs are used as locating devices during installation to locate the casting relative to the datum which is the uncut surface of the pavement 22.

In the preferred embodiment, the tabs are omitted. Location relative to the road surface is done by the bottom of the cleats 42 or treads contacting the bottom of the pocket 44 cut in the pavement. Given the accuracy of most cutting operations this should properly place the marker relative to the datum plane as well as the end of the ramp cut in the pavement.

The marker itself is placed in a cut in the pavement and adhered through the use of epoxy such as Mark 29 sold by the Poly-Carb Company. The retention of the marker in the roadbed is facilitated by downwardly projecting cleats 42 on the marker base. These cleats allow for interdigitation of epoxy to create greater mechanical holding power of the casting in the roadbed.

Massive keels are not required as in some prior art castings because plowing stress is inherently reduced due to the lower rail angles and reduced rail height above the pavement. The rail members 18 of the present invention are wider and therefore more robust than prior art castings. The rail members also are strengthened by the web 24 between the ramps which runs substantially the entire length of the marker allowing stresses to be transferred to or taken up by the web. Therefore, the rails provide similar functionality of prior art designs without requiring keels. The lack of keels eliminates cutting of the pavement with more than one blade size and reduces the installation cut depth.

FIG. 2 shows an embodiment in its preferred application. For installation, a long groove 14 is cut in the pavement. The groove starts at its shallow end and increases in depth as it leads to the reflector. This gradual deepening of the groove will extend for approximately four feet at which point the groove should be approximately ¼" deep. The groove is cut by a conventional pavement saw which is used for groove installation of prior art type markers. These saws have circular cutting blades. The depth of the cut is controlled by a cam on the cutting apparatus. The cam can be set for the rate of increase in depth. When the proper length and depth has been achieved, the rotation of the cam causes the blades to plunge in and make a much deeper cut in the range of 0.9" over the length of the marker so as to provide a pocket to hold the marker when installed. The long groove before the marker allows more light at a distance to enter the groove and radiate towards the reflector. Thus, a long shallow groove promotes light from oncoming headlamps being reflected and therefore observed by the vehicle driver. The marker is dimensioned and placed within the cut in the pavement so as to take advantage of this shallow channel while still protecting the reflector from snowplow blades.

FIG. 3 shows an enlarged portion of FIG. 2, namely the casting as installed in the pavement. In one embodiment, tabs straddle the pavement cut and rest on uncut pavement. This locates the casting relative to a datum plane which is the uncut pavement. Positioning the tabs at the datum level positions the leading edge of the web below road surface. This allows light that has been traveling down the cut channel to travel between the rails and impinge upon the reflector element. In the preferred embodiment, no tabs are used and the height relative to the datum plan is set by the cleats 42 set on the bottom of the pavement pocket 44.

If the leading edge of the web were positioned at or above road surface as in prior art devices, either the reflectance would be diminished or the reflector would have to be raised relative to the road surface, resulting in greater exposure to hazards such as plowing and reduced life of the reflector. In the preferred embodiment, the entry level of the web is approximately 0.150" below the datum level. The thickness at the leading edge of the web is approximately 0.30" and is accommodated in the pocket cut within the pavement. The current design facilitates a neat and clean installation by reducing the amount of epoxy overflow when embedding the marker in the pavement. Excess epoxy put within the cut in the pavement can exude into the space between the wall of the ramp and the wall of the cut. The amount of epoxy used should not cause excess epoxy to pool at the surface of the ramps, nor at the leading edge of web. In the preferred embodiment, the casting at its highest point above the road surface, will be approximately 0.15", 40% less than prior art low profile castings. The reflector 10 placed within the reflector pocket 30 will extend from below the datum surface to approximately 0.050" above the road surface. It will thus still be protected from snowplow blades while being exposed to impinging light over an area both above and below the road surface.

Figure 4:
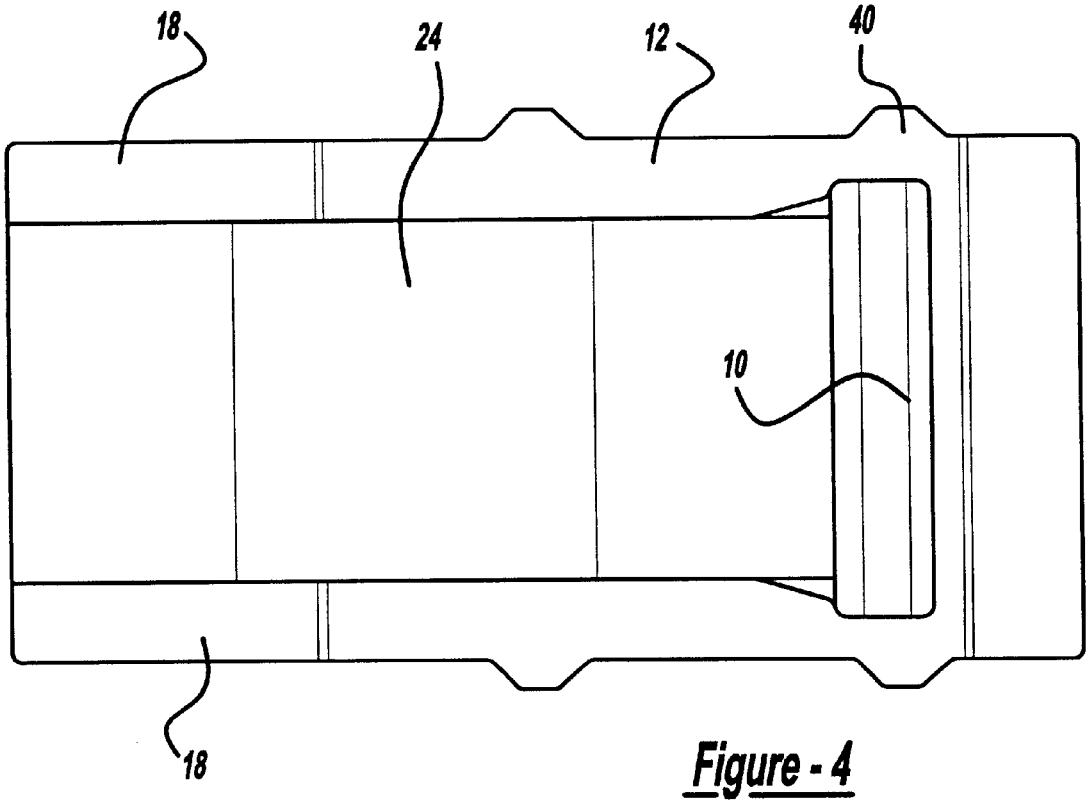
FIG. 4 is a plan view of FIG. 1.

Turning to FIG. 4, the width of the casting is approximately 5" in the preferred embodiment with approximately 3.5" spacing between the ramps. This distance is designed to allow and facilitate entry of vehicle tires in the space between the ramps, allowing them to impinge upon the reflector surface 10. When a tire or a portion of a tire enters the space between the ramps and contacts the surface of the reflector, the tread has a squeegee action upon the reflector, wiping road grime from at least a portion of the reflector. This is part of what is known in the trade as a self-cleaning action. Further, because of the relatively short distance that is achieved between the top of ramps and the web at the reflector pocket (on the order 0.50"), the tire passing over the marker also performs a vacuum cleaning function lifting debris from the channel between the rails as the tire passes.

FIG. 5 shows an alternative embodiment which is a two-way pavement marker. The overall length is less than twice that of the one way embodiment previously discussed, so as to keep weight and material to a minimum, whereas the previous one-way marker in its preferred embodiment is approximately 10" long, the two-way marker is preferably less than 12". Instead of being placed at one end of tapering groove, the two-way marker is placed at the center of a groove cut in the pavement, that groove tapering from shallow ends to the deepest portion being at the mid-point of the groove. Tabs, again, may but are not preferably used. If present, they can position the marker relative to a datum line which is the uncut pavement surface. Positioning of the web and reflective surface is similar to that as discussed in the one-way marker.

What is claimed is:

1. A pavement marker for mounting in a longitudinal cut in pavement comprising:

a cast base having longitudinally running and laterally spaced apart ramps to assist in carrying a snowplow blade over the top of the marker; and a web integrally formed between said ramps over substantially their entire length, said web having a leading edge placed within a longitudinal cut in a pavement surface at a level below and extending at least three lengths of said cast base said pavement surface so that light from oncoming vehicles traveling down said longitudinal cut can pass between said ramps at a level below said pavement surface.

2. The pavement marker of claim 1 further comprising a retroreflector element adhered to said web so that said light from said oncoming vehicles traveling down said longitudinal cut can be reflected from said reflector back towards the operator of said vehicles.

3. The pavement marker of claim 1 further comprising cleats extending from the bottom of said ramps to assist in adhering said marker base in said pavement.

4. A pavement marker installation comprising:

a pavement section having a pavement surface and a longitudinally extending groove cut therein, said groove generally increasing in depth in a longitudinal direction from a near end to a far end to allow light from oncoming vehicles to travel in said groove from said near end toward said far end; and a pavement marker placed at said far end of said groove, said pavement marker including:

a marker base adhered in said groove towards said far end, said marker base being less than ⅓ the length of said groove and having longitudinally extending and laterally spaced apart ramps starting at a level below said pavement surface and extending to a level above said pavement surface;

a web connecting said ramps, said web having a leading edge positioned below said pavement surface; and a reflector mounted on said web.

5. The pavement marker installation of claim 4 wherein said web is placed so as to allow said light to travel between said ramps and impinge on said reflector.

6. The pavement marker of claim 5 herein said base further comprises integrally formed tabs straddling said groove to position said base relative to said pavement.

7. The pavement marker installation of claim 6 wherein said pavement marker base is formed from cast iron.

8. The pavement marker installation of claim 4 wherein said groove is at least four times the length of said pavement marker base.

* * * * *